US005619771A

United States Patent [19]

Minic

[11] Patent Number: 5,619,771

[45] Date of Patent: Apr. 15, 1997

[54] OSCILLATING AND REVERSE CLEANING SOOTBLOWER

[75] Inventor: Michael J. Minic, Lebanon, Ohio

[73] Assignee: Effox, Inc., Cincinnati, Ohio

[21] Appl. No.: 514,260

[22] Filed: Aug. 11, 1995

[51] Int. Cl.[6] ..... A47L 5/38

[52] U.S. Cl. ..... 15/316.1; 122/390

[58] Field of Search ..... 15/316.1, 317, 15/318, 318.1; 122/390, 392

[56] References Cited

U.S. PATENT DOCUMENTS

| | | | |
|---|---|---|---|
| 2,442,045 | 5/1948 | Howse . | |
| 2,696,016 | 12/1954 | De Mart . | |
| 2,722,032 | 11/1955 | De Mart . | |
| 2,722,033 | 11/1955 | Glinn et al. . | |
| 2,902,707 | 9/1959 | Bearer, Jr. . | |
| 2,948,013 | 8/1960 | Bearer, Jr. . | |
| 3,216,046 | 11/1965 | Chappell . | |
| 3,230,568 | 1/1966 | Saltz . | |
| 3,604,050 | 9/1971 | Nelson et al. . | |
| 3,827,102 | 8/1974 | Adiutori | 15/317 |
| 4,165,552 | 8/1979 | Johnsto, Jr. . | |
| 4,207,648 | 6/1980 | Sullivan et al. . | |
| 4,222,144 | 9/1980 | Horner et al. . | |
| 4,351,082 | 9/1982 | Ackerman et al. . | |
| 4,487,165 | 12/1984 | Weber et al. . | |
| 4,492,187 | 1/1985 | Hammond . | |
| 4,803,959 | 2/1989 | Sherrick et al. . | |
| 4,996,951 | 3/1991 | Archer et al. | 15/318.1 X |
| 5,065,472 | 11/1991 | Carpenter et al. . | |
| 5,097,564 | 3/1992 | Billings . | |
| 5,337,438 | 8/1994 | Brown et al. . | |
| 5,337,441 | 8/1994 | Miyamoto et al. . | |
| 5,341,406 | 8/1994 | Jens et al. . | |

*Primary Examiner*—Chris K. Moore
*Attorney, Agent, or Firm*—Frost & Jacobs

[57] ABSTRACT

A sootblower is provided for cleaning boiler tubes with steam, in which individual time-delays allow the lance tube to move in an axial direction only for certain time intervals at the beginning of the extension and retraction strokes before the lance tube also begins to rotate. The sootblower can operate in a reverse cleaning mode in which the nozzle at the end of the lance tube continuously rotates in one direction during the entire extension stroke, then reverses its direction of rotation for the entire retraction stroke so that the paths of steam cleaning do not criss-cross during any given extension/retraction stroke. In a second embodiment of the sootblower, the nozzle on the lance tube oscillates between pre-determined minimum and maximum arcuate limits about the rotational axis of the lance tube.

13 Claims, 6 Drawing Sheets

OSCILLATING AND REVERSE CLEANING SOOTBLOWER

TECHNICAL FIELD

The present invention relates generally to boiler tube cleaning equipment and is particularly directed to a sootblower of the type which has an extendable lance that blows fluid (such as steam) out nozzles to clean the boiler tubes. The invention is specifically disclosed as a sootblower that rotates its nozzles in opposite directions when extending or retracting to achieve a reverse cleaning effect, and optionally will oscillate along an arc that is programmable by the user.

BACKGROUND OF THE INVENTION

Linear and rotational movement sootblowers have been available for some time, including devices that rotate the nozzles of its extendable lance so that the path of the cleaning fluid traces a helical path along the surfaces of the boiler tubes to be cleaned. U.S. Pat. No. 4,399,773 (by Schwade) discloses a sootblower having a slip coupling to allow rotation without a corresponding linear movement, along with a timer and limit switch to cause the nozzles of the lance tube to stop at different rotational positions at the end of each cycle. The Schwade device thereby traces different helical paths every time the lance goes through an extension and retraction cycle, so that it is possible to clean a greater area of the boiler tubes through several extension/retraction cycles. Several other patents also vary the rotation and travel of the nozzles of the lance tube to establish different helical blowing paths, including U.S. Pat. No. 3,604,050, U.S. Pat. No. 4,803,959, U.S. Pat. No. 5,065,472, U.S. Pat. No. 4,222,144, U.S. Pat. No. 5,097,564, and U.S. Pat. No. 2,442,045.

In addition to disclosures in patents, certain commercial sootblowers are presently available which establish different cleaning paths, including a Diamond Power IK sootblower having a feature called "Progressive Helix," and a Copes IK Long Retract that includes a device called "Random Cleaning."

Other conventional sootblowers achieve varying cleaning paths by using variable rates of rotation or axial movement of their lance, including disclosures in patents U.S. Pat. No. 4,492,187, U.S. Pat. No. 5,337,438, U.S. Pat. No. 5,337,441, U.S. Pat. No. 3,230,568, and U.S. Pat. No. 2,722,033.

The conventional sootblowers disclosed in the above patents and in the commercially-available products do not provide the user with easily adjustable control over the cleaning paths to clean the boiler tube surfaces with a minimum number of lance extension/retraction cycles. In addition, the conventional sootblowers having various types of lost motion devices do not allow for complete adjustability at the beginning of the extension and retraction strokes so that the variety of cleaning paths are somewhat limited.

SUMMARY OF THE INVENTION

Accordingly, it is a primary object of the present invention to provide a sootblower that has two separate drives, one for extension and retraction of the lance, and one for rotating the lance, in which the lance is rotated clockwise during extension and counterclockwise during retraction, thereby achieving reverse cleaning.

It is another object of the present invention to provide a sootblower that includes a rack and worm gear having a slotted keyway so that there is some rotational slippage at the start of each extension and retraction stroke.

It is a further object of the present invention to provide a sootblower that includes a timer to create an adjustable time delay before the rotation begins during the extension stroke of the lance, and a second timer to provide a separate independently adjustable time delay before the rotation begins during the retraction stroke.

It is a yet further object of the present invention to provide a sootblower in which the cleaning paths of the nozzles at the tip of the lance never criss-cross in the same extension/retraction cycle.

It is yet another object of the present invention to provide a sootblower in which the use of adjustable timers allows the ending position of the nozzle with respect to the starting position to be adjustable within a few degrees of 180°.

It is a yet further object of the present invention to provide a sootblower in which the nozzle movement of the lance during the extension and retraction cycle rotates through a pre-determined arc (less than 360°) so as to provide cleaning paths that remain within a particular portion of the arc of the helical fluid path, and in which said paths are easily adjusted by the user.

It is still another object of the present invention to provide a sootblower having a "homing" feature so as to provide greater accuracy by overcoming any inaccuracies due to wear and causing the chain to stretch and sprocket wear.

It is still a further object of the present invention to provide a sootblower that combines the reverse cleaning features and the oscillating features into one control unit, which is easily adjustable by the user so that virtually any helical arc path of fluid cleaning can be achieved, as well as any desired time delay selected after the lance begins to extend or retract before the nozzles begin to rotate.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved sootblower is provided in which individual time-delay intervals cause the lance tube to move only in an axial direction for a certain time interval at the beginning of the extension stroke before the lance tube begins to rotate its nozzle opening, and further the lance tube begins only axial movement at the beginning of its retraction stroke for a particular time interval before its begins to rotate its nozzle. Each of these two time intervals are independently adjustable by the system operator. Furthermore, the sootblower can operate in a reverse cleaning mode in which the nozzle continuously rotates in one direction during the entire extension stroke, then reverses its direction of rotation for the entire retraction stroke. In this manner, the path of fluid cleaning prescribed by the movements of the nozzle do not criss-cross during any given extension/retraction stroke.

In a more sophisticated control arrangement of the sootblower of the present invention, the nozzle on the lance tube can be caused to oscillate between predetermined maximum arcuate limits about the rotational axis of the lance tube. In this mode of operation, a further set of timers is used to delay the initial rotation of the lance tube as it begins its extension stroke, and then repeatedly rotates the lance tube in one direction from one angular position to the next, at which time the rotation of the lance tube is halted for a brief time interval, and then the lance tube is rotated in the opposite direction until the nozzle reaches the opposite arcuate limit, where once again, the rotation of the lance tube is halted for a time interval. Various local and remote electrical pushbutton controls can be actuated by local or remote system operators to either manually or automatically cause the lance tube to undergo an extension/retraction cycle. Furthermore, a proximity sensor can optionally be installed to determine whether or not the nozzle of the lance tube is within the proper arcuate limits at the moment the lance tube becomes fully retracted. If the nozzle is outside its proper arcuate limits, then the control circuit can automatically rotate the lance tube back to a position within the proper limits.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
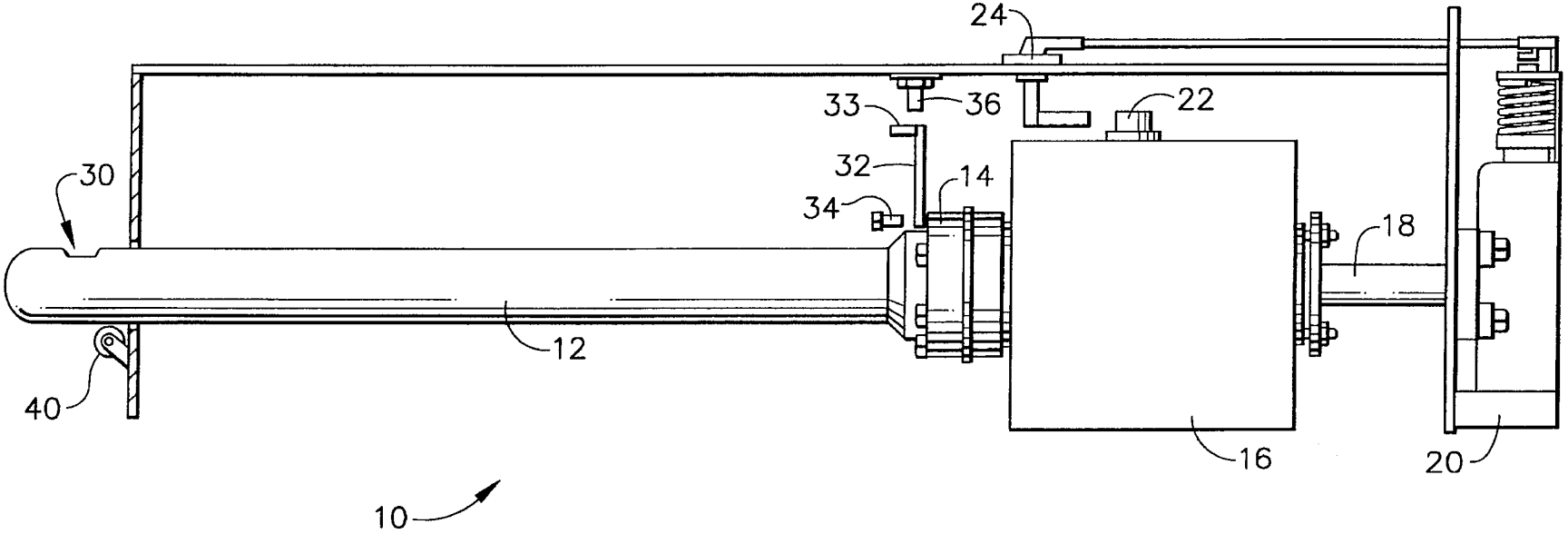
FIG. 1 is a side elevational view of a sootblower constructed in accordance with the principles of the present invention.

Referring now to the drawings, FIG. 1 shows the general configuration of a preferred embodiment of a sootblower, generally designated by the index numeral 10, which includes a lance tube 12, carriage assembly 16, and a steam supply tube 18. It will be understood that many different cleaning fluids could be used for sootblower 10 in lieu of steam, including air or water. The steam supply is run through a popper valve 20, through the supply tube 18, and into carriage assembly 16. When sootblower 10 is in use, a steam turn-on assembly 24 and steam turn-on pin 22 are actuated. The live steam flows through a lance tube flange 14 and further into the lance tube 12 itself, finally terminating at the end of the lance tube where there is a nozzle 30. As the steam rushes out the orifice of nozzle 30, it creates a steam jet which can clean boiler tubes in various patterns, depending upon the rotational and axial movements of lance tube 12.

Figure 2:
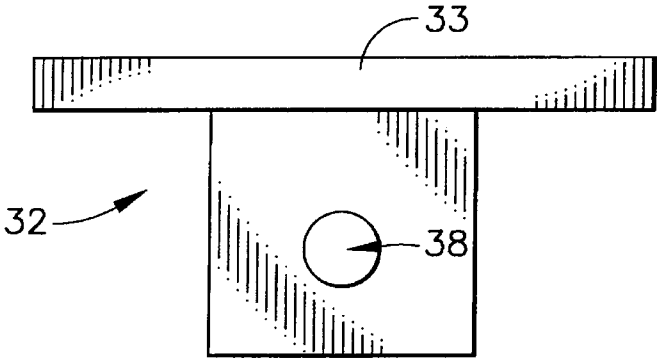
FIG. 2 is a front elevational view of a locator block which is attached to the sootblower of FIG. 1.

Lance tube 12 is shown in its extended position where it actuates a limit switch 40, also known as the "extend" limit switch. When lance tube 12 retracts, it will actuate another limit switch (not shown) known as the "retract" limit switch. When lance tube 12 is in its fully retracted position under normal operating conditions, a locator block 32 should be detected by a proximity sensor 36. Locator block 32 is attached to lance tube 12 via a bolt 34 through a clearance hole 38 (see FIG. 2) and is preferably constructed of carbon steel. If sootblower 10 is operating in the oscillating mode, the angular travel of the nozzle 30 will not move throughout the entire 360° arc of its potential rotational movement, but will instead be confined to a smaller angular travel, such as between 0° and 90°. In this circumstance, locator block 32 will preferably be shaped so that its horizontal portion 33 will be detected by proximity sensor 36 only when the nozzle 30 of lance tube 12 is between the 0° and 90° positions. If, due to sprocket wear or stretch of the chain drive, the lance tube 12 rotates its nozzle 30 past either the 0° or 90° position, then locator block 32 would not be detected by sensor 36, and while in the fully retracted position, lance tube 12 would be automatically caused to rotate by the electrical control circuit (described in detail below) until nozzle 30 once again became positioned within the correct 0° to 90° range.

It may be desirable to require the rotational position of lance tube 12 at the start of each extension stroke to be confined to a narrower angle to ensure that the nozzle 30 is cleaning a more repeatable oscillating pattern. This can be accomplished by shaping the horizontal portion 33 of locator block 32 to be relatively small in size, thereby constraining the beginning angular position of nozzle 30 to a relatively small angular range. The rotational positioning aspect of the present invention is discussed in detail below.

Figure 3:
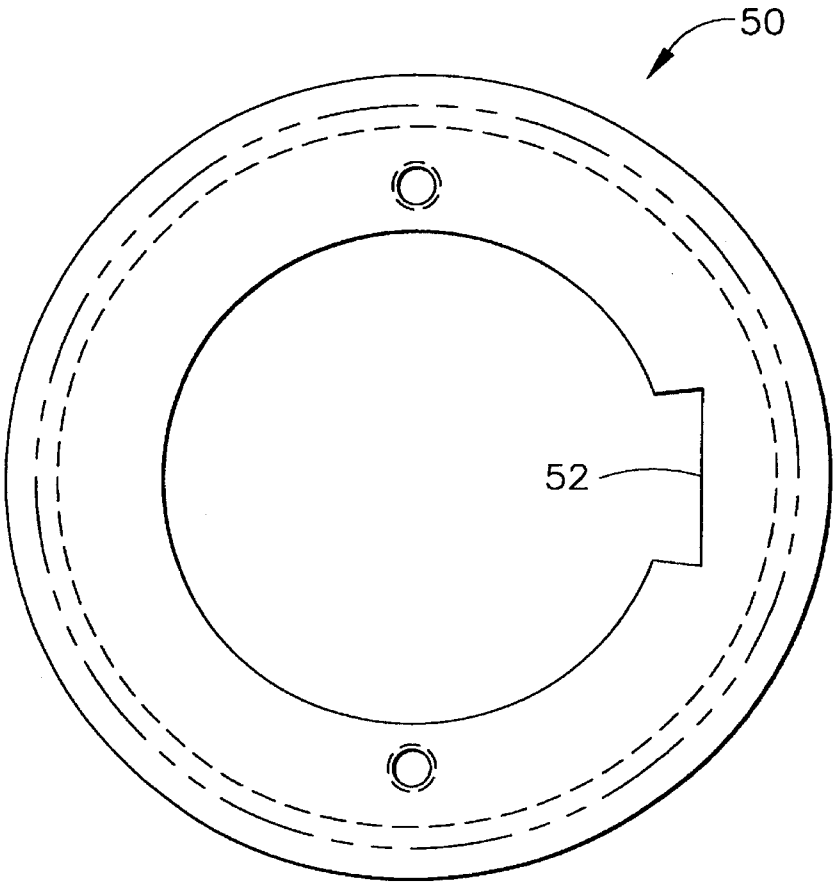
FIG. 3 is a cross-sectional view of an optional lost motion coupling that is integral to the sootblower of FIG. 1.

Sootblower 10 can also operate in a reverse cleaning mode, in which nozzle 30 first rotates continuously throughout its entire 360° range in one direction during the extension stroke, and then rotates continuously in the opposition direction throughout the entire 360° range during the retraction stroke. To ensure that nozzle 30 directs its steam at different locations on the boiler tube surfaces, several different methods have been used in conventional sootblowers. In the present invention, electronic timers are used to delay the initiation of rotational movement of nozzle 30 while the lance tube 12 already begins axial movement in both the extend and retract cycles. Furthermore, a lost motion device, generally designated by the index numeral 50 (see FIG. 3), can be attached to the driving mechanism within carriage assembly 16 to create a certain amount or rotational slippage so that nozzle 30 will not rotate until after lance tube 12 has axially moved a certain distance. Lost motion coupling 50 preferably has a keyway 52 which is wider than the key itself and which is attached to the drive mechanism within the carriage assembly 16. In this manner, the drive assembly that would normally rotate lance tube 12 will be allowed to slip a certain portion before engaging one side or the other of keyway 52.

Figure 4:
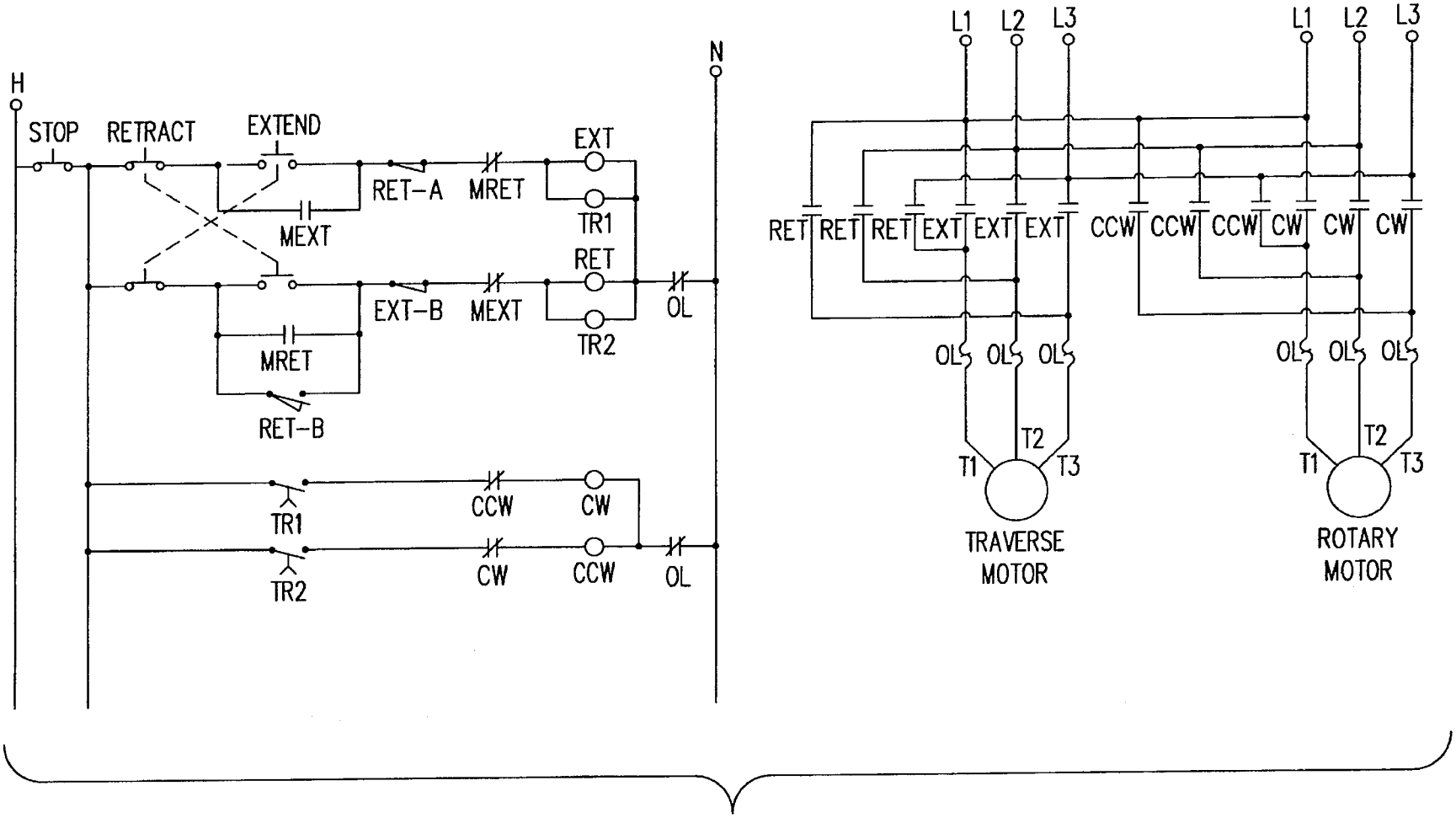
FIG. 4 is art electrical schematic diagram of a control circuit which is used to control a first embodiment of the sootblower of FIG. 1 acting in a reverse cleaning mode.

The electrical schematic of FIG. 4 depicts a control circuit used in controlling sootblower 10 in a reverse cleaning mode. On the right-hand portion of FIG. 4, the 460 volt AC, 3-phase power circuits are depicted for the traverse motor and the rotary motor. The traverse motor causes axial movement of lance tube 12, while the rotary motor causes rotational movement of the same lance tube. On the left-hand portion of FIG. 4, the control circuit using 110 volts AC is depicted, in which control power is provided to the motor starter designated "EXT" which energizes the traverse motor during the extension cycle, or control power can be supplied to the motor starter designated "RET", which energizes the traverse motor during the retraction stroke. Via timer contacts, control power is provided to a motor starter designated "CW" which energizes the rotary motor to cause lance tube 12 to rotate in the clockwise direction, and at other times is provided to another motor starter designated "CCW" which energizes the rotary motor to cause lance tube 12 to rotate in the counterclockwise direction.

The operation of the control circuit of FIG. 4 is relatively straightforward, in which the STOP pushbutton switch must be left in its normally-closed position, or none of the motor starters will be energized. To extend lance tube 12, the "EXTEND" pushbutton switch must be depressed, which allows control voltage to reach the EXT motor starter through a limit switch RET-A and a normally-closed auxiliary contact from the RET motor starter. Once the EXT motor starter has been energized, its normally-open auxiliary contact will close, thereby latching in the control power to continue to energize the EXT motor starter. At the same time, the normally-closed auxiliary contact from the EXT motor starter will open, thereby preventing energization of the RET motor starter. By use of this circuit diagram, the EXTEND pushbutton switch need only be momentarily depressed to initiate and maintain the extension stroke of lance tube 12.

Although lance tube 12 begins to travel in the axial direction as soon as the EXT motor starter is energized, it will not begin rotational movement until the CW motor starter is energized. This will not occur immediately, since a timer designated TR1 has an on-delay contact in series with the CW motor starter coil. Timer TR1 is energized at the same time the EXT motor starter is energized, so it will begin to time until its on-delay contact closes after its timing period has been completed. In an example where the time to complete the entire extension stroke is approximately 240 seconds, the time delay period for TR1 could be send to approximately 2 seconds. Lance tube 12 will thereby begin axial extension for 2 seconds before any rotational movement occurs, and after that 2 seconds has passed, lance tube 12 will rotate in a counterclockwise direction throughout the entire extension stroke.

Just before lance tube 12 reaches its fully extended position, limit switch RET-A will open, thereby de-energizing the EXT motor starter (and also the coil of timer TR1), so the axial movement of lance tube 12 will begin to halt because of the de-energization of the EXT motor starter, and the rotational movement of lance tube 12 will also begin to halt because the on-delay contact of TR1 will open, thereby de-energizing the CW motor starter. At the very end of the full extension travel, a second limit switch designated RET-B will close, thereby energizing the RET motor starter (and its associated timer TR2) through a normally-closed limit switch EXT-B and a normally closed auxiliary contact of the EXT motor starter (which is now closed since motor starter EXT has been de-energized). When this occurs, lance tube 12 will immediately begin to retract in the axial direction, however, it will not begin to rotate until the on-delay contact of timer TR2 closes. Once the contact of TR2 closes, the CCW motor starter will energize, thereby beginning rotation of lance tube 12 in the counterclockwise direction. After the RET motor starter has been energized, its normally-open auxiliary contact will close, thereby latching in control power to the RET motor starter, and its normally-closed auxiliary contact will open, thereby preventing the energization of the EXT motor starter. Similarly, once the CCW motor starter is energized, its normally-closed auxiliary contact will open, thereby preventing energization of the CW motor starter.

Lance tube 12 will continue to rotate in the counterclockwise direction throughout the entire retraction stroke, and this retraction movement will end only when the EXT-B limit switch is actuated, thereby opening the contact of that limit switch and de-energizing the RET motor starter. When that event occurs, lance tube 12 will cease axial movement, and since timer TR2 has its coil de-energized at the same time, lance tube 12 will also cease its rotational movement because the normally-open contact of TR2 will open and de-energize the CCW motor starter.

As can be seen from the above description, one momentary depression of the EXTEND pushbutton switch will cause an entire cycle of automatic extension and retraction of lance tube 12 of sootblower 10. The axial movement of the sootblower begins immediately in both the extension and retraction strokes, however, lance tube 12 will not rotate for pre-determined time periods (which are user adjustable) at the beginning of each of the extension and retraction strokes. The time delay settings of timers TR1 and TR2 are independently adjustable by the system operator, and would preferably have different timing interval values, such as 2 seconds for TR1 and 3.5 seconds for TR2. By use of these different timing intervals, the system operator can ensure that the position of nozzle 30 will cease movement at a different angular position at the end of the retraction stroke as compared to its initial angular position before the beginning of the extension stroke. In this way, the helical steam cleaning path on the steam jet leaving nozzle 30 will strike a different portion of the boiler tube surface during each extension and retraction cycle. After a number of such cycles, the entire surface of the boiler tubes will have been cleaned by the steam, because of the progressively changing helical paths due to the progressively changing angular positions of the nozzle 30 at the beginning of each extension stroke.

It will be understood that the "RETRACT" pushbutton switch can be used to manually retract the lance tube 12 at any time. It will be further understood that the overload contacts of the traverse motor can interrupt the energization of the EXT motor starter and the RET motor starter. It is also understood that the overload contacts of the rotary motor can interrupt the operation of the CW motor starter and the CCW motor starter.

Figure 5:
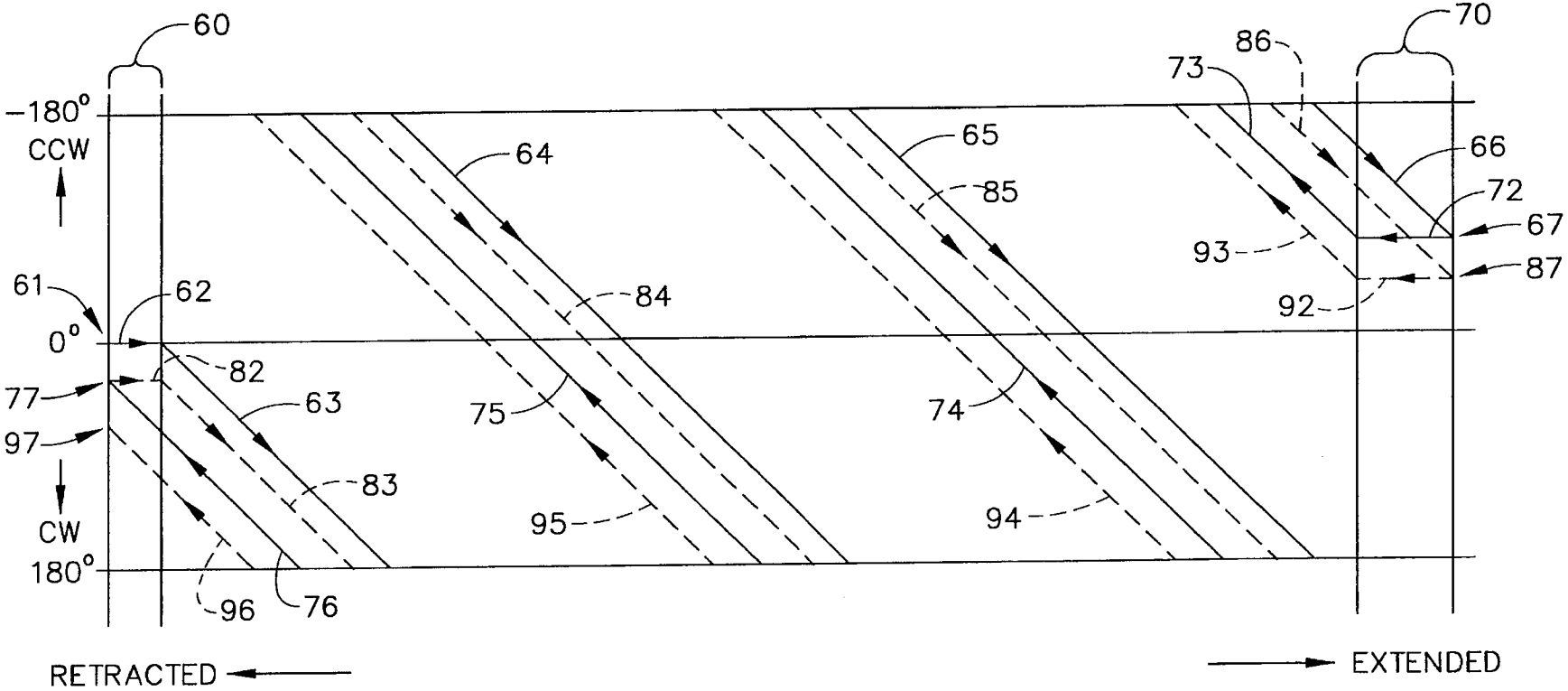
FIG. 5 is a diagram showing the position of the nozzle of the sootblower of FIG. 1 as the nozzle moves in both the axial and rotational directions of a sootblower operating in the reverse cleaning mode.

The chart of FIG. 5 will help to illustrate the advantages of the reverse cleaning mode of sootblower 10. Assuming the lance tube 12 is at the 0° position initially, at the beginning of the extension stroke the position of nozzle 30 will begin at the point designated by the index numeral 61, and will continue along the 0° angular position along the line segment designated by the index numeral 62 for the time interval designated by the index numeral 60. This time interval is preferably 2 seconds in many applications, and once the 2 seconds has expired, lance tube 12 will begin to rotate in the clockwise direction as indicated by the line segment 63. This clockwise rotation will continue down to the 180° angular position, and will wrap-over to the −180° position on FIG. 5, as shown by the line segment 64 (which physically is continuous clockwise movement while extending). The angular and axial movements will continue so that nozzle 30 then travels along said line segment 65 and line segment 66 until it reaches the end travel position at the point designated by the index numeral 67.

All rotational and axial movement of lance tube 12 stops momentarily, however, lance tube 12 then begins to retract while not rotating for the time interval designated by the index numeral 70 (preferably 3.5 seconds in many applications), as indicated by the horizontal line segment 72. After that time interval has expired, nozzle 30 will begin to rotate in the counterclockwise direction as shown by line segment 73. This counterclockwise rotational movement continues throughout the axial travel of lance tube 12, and the nozzle path will continue along line segments 73, 74, 75, and 76, until the fully retracted position of axial tube 12 is achieved, at the point designated by the index numeral 77. As can be easily seen on FIG. 5, the rotational or angular position of nozzle 30 at the point designated 77 is not the same as the initial 0° rotational or angular position before the extension stroke of the first cycle (designated by the index numeral 61 ). Under these circumstances, the next time lance tube 12 goes through an extension/retraction cycle, its steam jet will strike a different portion of the boiler tubes that are to be cleaned.

At the beginning of a second extension/retraction cycle, the nozzle 30 will travel along the horizontal line segment 82 (in dashed lines on FIG. 5) during the time delay period designated by the index numeral 60. After the time interval has expired, lance tube 12 and nozzle 30 will begin to rotate in the clockwise direction, as indicated by the dashed line segment 83, and will continue its clockwise rotation as indicated by line segments 84, 85, and 86. At the furthest extension travel position, designated by the index numeral 87, all axial and rotational movement will briefly halt, and then lance tube 12 will begin to retract in the axial direction. As indicated by the horizontal dashed line segment 92, lance tube 12 does not rotate during the time interval designated by the index numeral 70. Once that time interval has expired, nozzle 30 (in lance tube 12) will begin rotating in the counterclockwise direction, as indicated by the line segments 93, 94, 95, and 96. At the fully retracted position, the lance tube 12 and the angular position of the nozzle 30 will cease to move at the point designated by the index numeral 97. As can be easily seen, the angular position of nozzle 30 is now in a new position with respect to the index numerals 77 and 61 on FIG. 5.

It will be understood that the time intervals 60 and 70 on FIG. 5 can be easily adjusted to meet various stroke distance requirements for any particular sootblower without departing from the principles of the present invention. Furthermore, the rotational speed and axial travel speed of lance tube 12 can be varied to meet a precise application, however, the overall steam path tracings against the boiler tubes to be cleaned will still generally appear as on FIG. 5.

Figure 6:
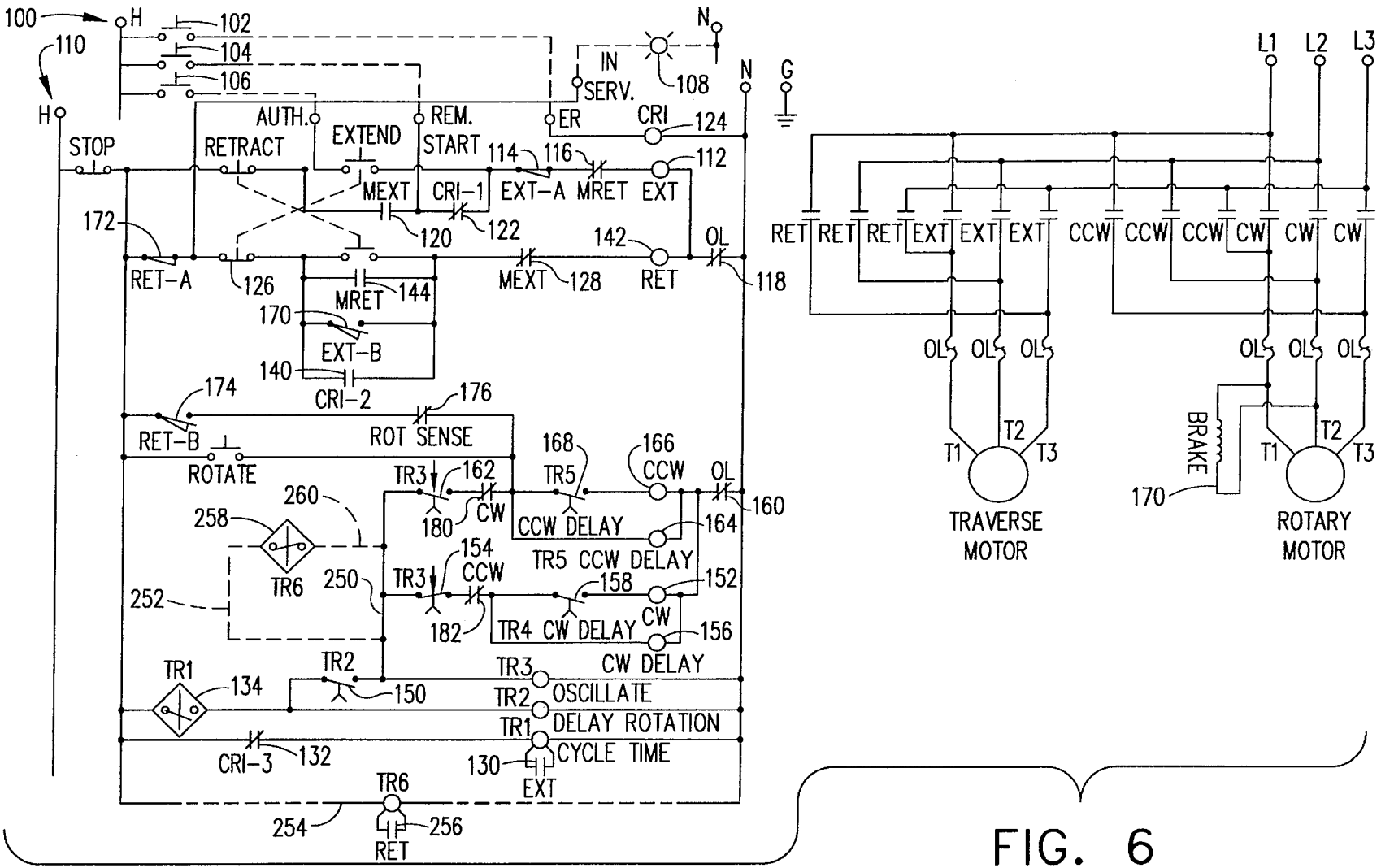
FIG. 6 is an electrical schematic diagram of a control circuit used to control a second embodiment of a sootblower of FIG. 1 acting in an oscillating mode.

The electrical schematic diagram of FIG. 6 discloses an automatic control circuit that can be used to control the sootblower 10 in either an oscillating mode or a reverse cleaning mode. Certain of the control switches can be located at a remote station, and powered from a remote power source, such as indicated by the index numeral 100 on FIG. 6. For example, a remotely located normally-open pushbutton switch 102 can be used for an "Emergency Retract" function, a second normally-open pushbutton switch 104 can be used as a "Remote Start" control, and a third normally-open pushbutton switch 106 can be used to remotely control whether or not there is authorization to allow a manual cycle start. In addition, an indicating lamp 108 can be remotely mounted which, when illuminated, indicates that sootblower 10 is "In Service".

In the illustrated embodiment of FIG. 6, the local control power for the remainder of the electrical schematic is indicated by the index numeral 110. This portion of the electrical control circuit includes five (5) timers and four (4) pushbutton switches. The five timers can be adjusted by the system user to control the overall cycle time of a single extension/retraction cycle, the amount of time delay before rotation begins at the beginning of axial movement of the lance tube 12 during an extension stroke, the amount of time lance tube 12 rotates in one direction to create a particular arcuate cleaning path, the amount of time the rotary motor is to remain in its brake mode during a clockwise rotation, and the amount of time the rotary motor is to remain in its brake mode during a counterclockwise rotation. The four pushbuttons can cause sootblower 10 to extend its lance tube 12, retract its lance tube 12, rotate lance tube 12, and stop the entire system from performing any function. The operation of these controls is described in detail below.

As can be easily discerned in FIG. 6, the STOP pushbutton switch must be in its normally-closed position to allow control voltage to reach any of the motor starters in the control circuit. In a mode of operation where the system operator is located at the control panel of sootblower 10, the EXTEND pushbutton switch is momentarily depressed to initiate an extension/retraction cycle. Once this occurs, control voltage will be supplied to the EXT motor starter (at index numeral 112), so long as the EXT-A limit switch remains closed (at index numeral 114) and a normally-closed auxiliary contact of the RET motor starter (at index numeral 116) remains closed. Of course, the traverse motor overloads at index numeral 118 must also remain closed, or the traverse motor will obviously not turn. Once the EXT motor starter 112 has been energized, its normally-open auxiliary contact at index numeral 120 will latch in the EXTEND pushbutton switch start command, unless the normally-closed contact of control relay CR1 (at index numeral 122) should be open. This normally-closed contact would be open only if the emergency retract remote pushbutton switch 102 was being depressed, thereby energizing the coil CR1 at index numeral 124. The depressing of the EXTEND pushbutton switch also causes its normally-closed contact at index numeral 126 to open, thereby preventing the RET motor starter to be energized, and further, once the EXT motor starter 112 has been energized, its normally-closed auxiliary contact at index numeral 128 will also open to prevent the RET motor starter from energizing.

Another normally-open auxiliary contact (at index numeral 130) of the EXT motor starter is used to initiate operation of TR1, which is the cycle timer of this control circuit. Timer TR1 preferably is a "universal" electronic timer manufactured by Syrelec and having a part number 88-857-005, which is a digital timer that will close its normally-open timed contact immediately upon the closure of the EXT contact 130, however, it will stop all timing functions if its input terminal that is connected to a normally-closed contact of CR1 (at index numeral 132) should happen to open and remove control power from that input terminal of TR1. Once the EXT auxiliary contact 130 closes in normal operation, timer TR1 will continue to count time until the end of its pre-set time interval, and then it will operate its time-delayed contact. In the control circuit illustrated in FIG. 6, the time-delayed contact of TR1 is at the index numeral 134, and this contact closes immediately when the EXT auxiliary contact 130 closes, and will open after its time interval has expired. If the normally-open relay contact 132 should open and remove power to an input terminal of TR1, the time-delayed contact 134 will open immediately. The time interval setting for TR1 preferably will be quite lengthy, such a setting of 480 seconds, which would provide 240 seconds of extension and another 240 seconds of retraction of the lance tube 12.

The extension of lance tube 12 can also be caused by a momentary closure of the Remote Start pushbutton switch 104, and this will have precisely the same effect as if the local system operator pushed the local EXTEND pushbutton switch unless the Emergency Retract remote pushbutton switch 102 has also been depressed. In this manner, the local operator can defeat an Emergency Retract command from pushbutton switch 102 if the local operator presses the EXTEND pushbutton switch, however, if the remote system operator presses both the Emergency Retract 102 and the Remote Start pushbutton 104 simultaneously, then the emergency retract function "wins", and lance tube 12 will be retracted, rather than extended. In the instance of the Emergency Retract pushbutton switch 104 being depressed, relay CR1 at 124 will be energized, thereby closing its normally-open contact at index numeral 140, and opening its normally-closed contact at index numeral 122. As long as the local EXTEND pushbutton switch is not being held down, the EXT motor starter 112 will become de-energized, and the RET motor starter at index 142 will become energized, thereby retracting lance tube 12. Once RET motor starter 142 has been energized, its normally-open auxiliary contact at index numeral 144 will close and latch in the control power to its coil at 142. Furthermore, its normally-closed auxiliary contact at 116 will open, thereby preventing the energization of the EXT motor starter.

In automatic mode of operation, the local EXTEND pushbutton switch or the Remote Start pushbutton switch 104 need only be momentarily depressed to cause sootblower 10 to undergo a cycle of extension and retraction. As related above, the auxiliary contact 130 of the EXT motor starter will cause timer TR1 to operate, and when its time-delayed contact 134 closes, a second timer TR2 will begin to time to delay the rotation of lance tube 12 for a particular time interval. A recommended time interval setting tier delay rotation timer TR2 is 3.2 seconds, so that its normally-open time-delayed contact at index numeral 150 will close at a time of 3.2 seconds after lance tube 12 begins to extend. Once contact 150 has closed, control power will be able to reach either the CW motor starter or the CCW motor starter, which will cause the traverse motor to rotate in either the clockwise or the counterclockwise direction.

In the illustrated embodiment of FIG. 6, the CW motor starter at index numeral 152 will be initially energized after a time delay-see below--because of a normally-closed time-delayed contact at index numeral 154 of a timer TR3. Timer TR3 is a repeat-cycle timer, and in the oscillating mode of operation of sootblower 10, it controls the amount of "off" time of the rotary motor between clockwise and counterclockwise rotation periods. Since its time-delayed contact at 154 is normally-closed, control power will immediately (after timer TR2 has its contact 150 closed) energize the coil of TR4 (at index numeral 156), which causes a normally-open on-delay contact of TR4 at index numeral 158 to close after its time-interval has expired, thereby energizing the CW motor starter at 152. When this occurs, lance tube 12 will rotate in the clockwise direction, until the contact of TR3 at index numeral 154 opens. Since TR3 is a repeat-cycle timer, its time-delayed contacts will repetitively open, then close, for pre-determined time intervals. In the preferred embodiment, the ON-time and OFF-time are set to equal time intervals of 1.6 seconds. Of course, the overloads at index numeral 160 must be closed to allow the rotary motor to turn.

Once TR3 has its contacts change state, its normally-open contact at index numeral 162 will close at the same time as its normally-closed contact 154 opens, thereby de-energizing the CW motor starter at 152 (and also TR4 at 156), and immediately energizing the timer TR5 at index numeral 164, and ultimately energizing the CCW motor starter at 166. Once TR5 has been energized at 164, its normally-open on-delay contact at index numeral 168 will close after its time interval period has expired, thereby energizing the CCW motor starter at 166. This will cause the rotary motor to rotate in the counterclockwise direction until the oscillate time TR3 has its contacts change state once again, and when that occurs, contact 162 will open and contact 154 will close, thereby starting the oscillating cycle again.

Both the CW motor starter 152 and the CCW motor starter 166 have normally-closed auxiliary contacts which prevent the energization of the opposite motor starter when either one of these devices has already been energized. If the CW motor starter 152 is energized, its normally-closed contact at location 180 will open, thereby preventing the energization of the CCW motor 166, except due to the manual operation of the ROTATE pushbutton switch, or due to the actuation of the RET-B limit switch 174 in combination with the rotate sensor contact 176. If the CCW motor starter 166 is energized, then its auxiliary contact 182 will open, thereby preventing energization of the CW motor starter 152.

In the oscillating mode of operation of sootblower 10, the preferred time settings for timers TR4 and TR5 are 0.5 seconds for each timer. Since the oscillate timer TR3 is set to 1.6 seconds, the rotary motor will stop turning for a time period of 0.5 seconds due to the delay of either the on-delay contact of TR4 at 158 or the on-delay contact of TR5 at 168. Once either one of these contacts has timed out and closes, then the rotary motor will be energized via either the CW motor starter at 152 or the CCW motor starter at 166. Rotary motor is a brake motor, as indicated at the index numeral 170 on FIG. 6. The brake is operable at any time that the rotary motor is not energized in either its clockwise or counterclockwise direction. If the oscillate timer TR3 is set to 1.6 seconds, as related above, the lance tube 12 will rotate approximately 45° during the 1.1 seconds that it rotates in either the clockwise or counterclockwise direction per cycle described above.

The overall operation of the rotation of lance tube 12 will then be a repeated cycle of braking operations for 0.5 seconds, then clockwise rotation for 1.1 seconds, another braking operation for 0.5 seconds and a counterclockwise rotation for 1.1 seconds. It will be understood that a larger or narrower arcuate cleaning path can easily be established by changing the time delay setting of the oscillate timer TR3, and further, if the time setting for TR3 is made long enough (e.g., tier a time interval greater than 10 seconds), then nozzle 30 will rotate an entire 360° per oscillation cycle. Of course, if that 360° range of rotation is desired, then the oscillate timer TR3 may be set to a much greater time to allow continuous turning of lance tube 12 in either its clockwise or counterclockwise direction. This mode of operation will be described in greater detail below, and is very similar to the reverse cleaning mode of operation related above, and depicted in FIGS. 4 and 5.

The preferred devices for timers TR1, TR2, and TR3 are the Syrelec digital timers, part number 88-857-005, and the preferred devices for the on-delay timers TR4 and TR5 are manufactured by Furnas, part number 49MC06FF. The preferred contactors for all four motor starters are manufactured by Furnas, having a part number 21CF32AFE, the preferred overloads are Furnas 48AH040, and the preferred auxiliary contacts are Furnas 49ABT6.

As lance tube 12 extends from the carriage assembly 16, it will ultimately engage two limit switches near or at the end travel positions of maximum extension. As lance tube 12 approaches its maximum extension, it actuates limit switch EXT-A 114, thereby causing it to open and de-energize the EXT motor starter 112, which causes the traverse motor to stop turning. Due to inertia, lance tube 12 will continue to further extend a short distance, and will engage a second limit switch EXT-B, designated by the index numeral 170, which causes the RET motor starter 142 to be energized (by allowing control voltage to reach its coil through a normally-closed RET-A limit switch 172, the normally-closed contact 126 of the EXTEND pushbutton switch, the normally-closed auxiliary contact of the EXT motor starter 128, and, of course, the overloads 118 of the traverse motor. Now that RET motor starter 142 is energized, its normally-open auxiliary contact 144 closes and latches in control voltage to its coil 142, and its normally-closed auxiliary contact 116 opens, thereby preventing the energization of the EXT motor starter 112. All of these operations occur automatically, and the clockwise and counterclockwise rotation of lance tube 12, due to the rotary motor turning in one direction, braking, then turning in the other direction and braking, will continue during the end of the extension stroke, its slowing down and reversing its movement along the axial directions so that it then retracts.

It will be understood that lance tube 12 can be manually caused to retract at any time during its extension/retraction cycle if the local system operator depresses the RETRACT pushbutton switch (which opens the circuit to the EXT motor starter 112 and closes the circuit to the RET motor starter 142), or if the emergency retract pushbutton 102 is depressed by the remote system operator, thereby energizing the control relay CR1.

As lance tube 12 retracts, the same oscillation cycle with respect to its rotational movements of nozzle 30 will continue to provide a steam cleaning path within the predetermined angular positional limits of nozzle 30. As lance tube 12 nears its fully retracted position, it will actuate two limit switches, RET-A and RET-B. Just before the maximum retraction position has been reached, limit switch RET- A (designated by the index numeral 172) will open, thereby causing the RET motor starter 142 to de-energize. The traverse motor will then lose power, and the axial direction of lance tube 12 will staff to cease. However, due to inertia, lance tube 12 will further continue to retract a short distance, and will actuate the RET-B limit switch designated by the index numeral 174, which will activate a sensing circuit that corrects any mis-positioning of the nozzle 30 if that nozzle's end position happens to be outside the pre-programmed arcuate cleaning path of lance tube 12.

A metal-sensing proximity sensor 36 (see FIG. 1) is located so as to detect the locator block 32 if the angular position of lance tube 12 at its end travel, fully-retracted position is within the correct angular parameters tier the application of this particular sootblower 10. If the locator block 32 is indeed in the correct position, then the rotation sensor contact, designated by the index numeral 176, will be opened by proximity sensor 36, and no control voltage will reach the CCW on-delay timer TR5 at index numeral 164. If, however, locator block 32 is not in its correct position, then the contact 176 will remain closed, and when limit switch RET-B at location 174 closes (at the fully retracted position of lance tube 12), then TR5 at location 164 becomes energized, and after a 0.5 second time delay interval, its normally-open time-delayed contact 168 will close, thereby causing the CCW motor starter 166 to be energized. Lance tube 12 will then be rotated in the counterclockwise direction (while not moving in the axial direction) until the locator block 32 moves into a position so that the proximity sensor 36 can detect its presence, thereby opening the remote sense contact 176 and halting the counterclockwise movement of lance tube 12 by de-energizing the CCW motor starter 166. This additionally rotating operation of lance tube 12 is normally not required, however, due to sprocket wear and stretch of the chain drive of the carriage assembly 16, the nozzle 30 will find itself outside the prescribed angular range from time-to-time.

The ROTATE pushbutton switch can also be used to manually cause the counterclockwise rotation of lance tube 12 by energizing the coil of TR5, and after a time-delay of 0.5 seconds, energizing the CCW motor starter 166.

It will be understood that many different timer settings for the timers included in the electrical schematic control circuit of FIG. 6 can be used to create the oscillating mode of operation of sootblower 10 without departing from the principles of the present invention. It will also be understood that the exact circuit configuration of the electrical schematic of FIG. 6 can be altered to create similar modes of operation of sootblower 10 without departing from the principles of the present invention. It will further be understood that the use of the limit switches to control the axial movements of lance tube 12, and the use of the timers and the proximity sensor to control the rotational movements of lance tube 12 can be modified without departing from the principles of the present invention.

When sootblower 10 is used in the oscillating mode, the time duration of timer TR1 should be set to correspond to the length of time for lance tube 12 to move throughout its entire extension and retraction cycle, which is normally a rather long time such as 480 seconds in the examples related above. The oscillating cycle time is determined by the amount of time that lance tube 12 physically needs to rotate through the desired arc to spray one helical segment of the proper steam cleaning path, and in the example related above, that time interval was 1.1 seconds, during which time lance tube 12 would rotate 45°. Before the time interval of timer TR3 can be determined, however, the system operator must consider the additional time delay provided by timers TR4 and TR5, which cause the rotary motor to apply its brake 170 for a certain time duration before the rotary motor is energized to rotate lance tube 12. In the example related above, both timers TR4 and TR5 were preferably set at 0.5 seconds, so that the time interval setting for timer TR3 was a total of 1.6 seconds, which is the sum of the 0.5 second braking time of timers TR4 and TR5, and the desired lance rotation time period of 1.1 seconds. The initial rotation delay time interval is determined by the setting of timer TR2, which preferably would be approximately 3.2 seconds in the above example. This 3.2 second delay approximates the amount of time that the rotary motor would oscillate throughout an entire clockwise/counterclockwise movement, which as related above, would be 1.6 seconds plus 1.6 seconds (thereby equalling 3.2 seconds). It will be understood that each of these time settings for the five timers depicted in FIG. 6 can be adjusted as desired to meet the requirements of any particular sootblowing application without departing from the principles of the present invention.

The control circuit depicted in the left-hand side of FIG. 6 can also be used to place sootblower 10 in a reverse cleaning mode. If timer TR3 is set to ½ the time interval of the cycle timer TR1, then sootblower 10 will extend its lance tube 12 while lance tube 12 rotates in the clockwise direction continuously throughout the extension stroke. At the end of that stroke, timer TR3 would time out, and its normally-open and normally-closed contacts 162 and 154, respectively, would change state, thereby energizing the CCW motor starter 166 and the de-energizing the CW motor starter 152. Once this has occurred, lance tube 12 will begin to retract while rotating in its counterclockwise direction, and these counterclockwise rotations will be continuous throughout its retraction stroke.

When used in the reverse cleaning mode, sootblower 10 will clean a helical steam path of the entire 360° circle about the axis of lance tube 12, in a similar manner as provided by the control circuit depicted in FIG. 4. In the reverse cleaning mode of operation, it is preferred that the time setting of timer TR4 is set to 0.5 seconds, while the setting for timer TR5 is set to 3.0 seconds. In this manner, the initiation of clockwise rotational movement of lance tube 12 during the extend stroke will be delayed by the total amount of time of the settings of timers TR2 plus TR4 (in the above example, a total of 3.7 seconds=3.2+0.5), and lance tube 12 will have its counterclockwise rotation during the retract stroke delayed by approximately 3.0 seconds just after lance tube 12 has reached its fully extended position. In this configuration, timer TR2 acts in a very similar manner as timer TR2 in the electrical control circuit of FIG. 4, and timer TR5 acts in a very similar manner to timer TR1 in the control circuit of FIG. 4. There is essentially a direction correlation between the operations of these timers of these two separate control circuits.

Figure 7:
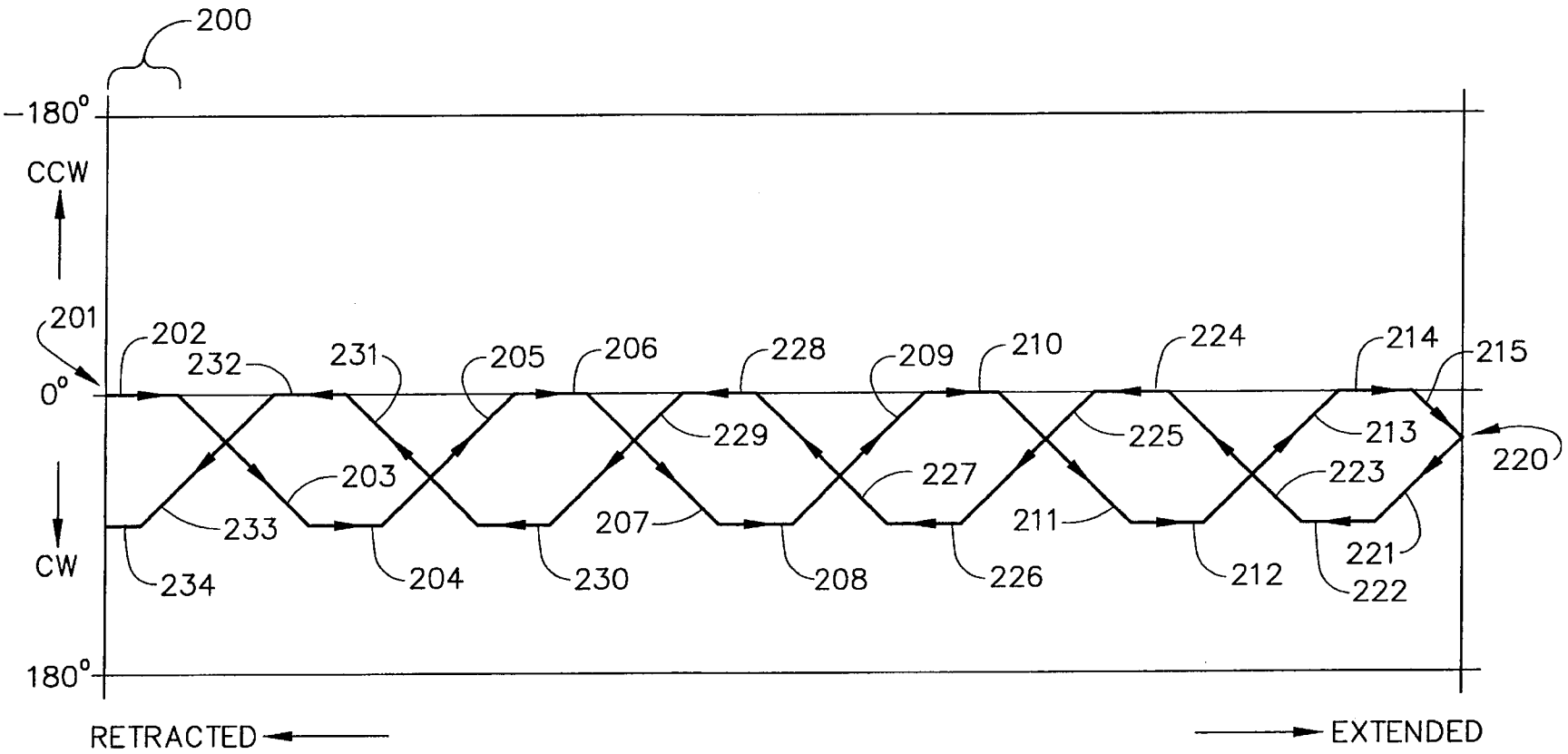
FIG. 7 is a diagram showing the position of the nozzle of the sootblower of FIG. 1 as the nozzle moves in both the axial and rotational directions of a sootblower operating in the oscillating mode.

The chart of FIG. 7 illustrates the advantages of the oscillating mode of sootblower 10. Assuming the lance tube 12 is at the 0° position initially, the position of nozzle 30 will begin the extension stroke at the point designated by the index numeral 201, and will continue along the 0° angular position along the segment designated by the indent numeral 202 for the timer interval designated by the index numeral 200. This time interval is preferably about 3.7 seconds in many applications, which is a result of the timer TR2 having a time interval setting of 3.2 seconds and the timer TR4 having a setting of 0.5 seconds. Once this time interval 200 has expired, lance tube 12 will begin to rotate in the clockwise direction along the line segment 203, and will stop its rotational movement as indicated by the line segment 204 because the contacts of timer TR3 will have changed state while the time delay contact of timer TR5 causes the rotational movement of lance tube 12 to cease. Once the contact of timer TR5 closes, lance tube 12 rotates in the counterclockwise direction as indicated by the line segment 205 until the timer TR3 causes its contacts to change state once again, thereby braking the rotational movement of lance tube 12, as indicated by the line segment 206. This cycle repeats as indicated by the line segments 207, 208, 209 and 210; a further cycle is indicated by line segments 211, 212, 213, and 214, finally ending in a partial line segment 215 after which time lance tube 12 has reached its fully extended position, at which time the nozzle 30 continues to rotate while momentarily passing the point designated by the index numeral 220.

Lance tube 12 now begins to retract, and its clockwise rotation continues as indicated by the line segment 221 until the timed contacts of timer TR3 again change state, as indicated by the line segment 222. During the retraction stroke, the nozzle 30 of lance tube 12 repeatedly oscillates through multiple clockwise and counterclockwise movements, as indicated by the line segments 223, 224, 225, 226 (for one cycle), 227, 228, 229, 230 (for a second cycle), 231, 232, 233, and 234. The horizontal line segment 234 indicates that the nozzle 30 of lance tube 12 is not rotating in this particular example as the lance tube reaches its fully retracted position.

As can be easily discerned when comparing FIGS. 5 and 7, the path of steam cleaning of nozzle 30 is quite different in the oscillating mode than it was in the reverse cleaning mode. In the oscillating mode, it is clear that the rotational movements of lance tube 12 are confined within certain arcuate limitations, due to the operation of the repeat cycle timer TR3. This can be important in many applications in which the boiler tubes to be cleaned are only on one side of the lance of sootblower 10, and particularly important when other equipment that cannot tolerate contact with live steam are located in other regions near sootblower 10.

As an option, the control circuit depicted in FIG. 6 may further include another timer TR6 to delay the rotation of lance tube 12 at the beginning of the retraction stroke when sootblower 10 is operating in its oscillating mode. Timer TR6 preferably is a digital universal timer, part number 88-857-005, manufactured by Syrelec, and is continuously powered by control voltage via a wire at the index numeral 254. The timed contact for TR6 is inserted in the vertical branch of the schematic diagram designated by the index numeral 250, such that the dashed lines 252 and 260 are substituted for that vertical branch 250 when using this option. In this configuration, control power from timer contact 150 of TR2 cannot reach the timer contacts 154 and 162 of TR3 without first crossing through the optional timer contact 258 of TR6.

When the extension stroke has finished and motor starter RET at 142 energizes, another normally-open auxiliary contact at 256 will close and cause the timer contact 258 of TR6 to operate. Timer contact 258 is a normally-closed contact which will open immediately upon the closing of the RET auxiliary contact 256. After that has occurred, timer contact 258 will remain open during its time-delay interval (preferably 1.6 seconds), then close at the end of that time-delay interval. According to this scheme, lance tube 12 will cease to rotate (in either direction) at the beginning of the retraction stroke, and lance tube 12 will move only in the axial direction (as it retracts) for the 1.6 second time-delay interval before it begins to again rotate. By selecting a time-delay interval of 1.6 seconds, it will be assured that lance tube 12 will begin to rotate in the opposite direction (clockwise or counterclockwise) as compared to its direction of rotation just before the moment the retraction stroke began, which can be a desirable event in some cleaning applications.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A sootblower comprising a movable lance tube, a carriage assembly, a source of cleaning fluid, a first motor which drives said lance tube axially along its centerline to both extend and retract the lance tube, a second motor which drives said lance tube rotationally about its centerline in both the clockwise and counterclockwise directions, a first timer which delays the rotation of said lance tube at the beginning of the extend stroke or the lance tube, and a second timer which delays the rotation of said lance tube at the beginning of the retract stroke of the lance tube.

2. The sootblower as recited in claim 1, wherein said lance tube includes a nozzle near the distal end of the lance tube with respect to said carriage assembly, said nozzle emitting a jet of cleaning fluid during said extend and retract strokes.

3. The sootblower as recited in claim 2, wherein said fluid jet prescribes a helical cleaning path as said lance tube rotates during said extend and retract strokes.

4. The sootblower as recited in claim 3, wherein said lance tube continuously rotates in the clockwise direction during said extend stroke after the first timer has timed out, and continuously rotates in the counterclockwise direction during said retract stroke after the second timer has timed out.

5. The sootblower as recited in claim 4, wherein said helical cleaning path prescribed during the extend stroke does not criss-cross with the helical cleaning path prescribed during the retract stroke.

6. The sootblower as recited in claim 1, wherein said first and second timers are set to two different time-delay settings.

7. A sootblower comprising a movable lance tube, a carriage assembly, a source of cleaning fluid, a first motor which drives said lance tube axially along its centerline to both extend and retract the lance tube, a second motor which drives said lance tube rotationally about its centerline in both the clockwise and counterclockwise directions, and a control circuit that compels said lance tube to repeatedly rotationally oscillate clockwise and counterclockwise between pre-determined end limits of angular travel during both the extend stroke of the lance tube and the retract stroke of the lance tube.

8. The sootblower as recited in claim 7, wherein said control circuit brakes said second motor between the end of each clockwise movement and the beginning of each subsequent counterclockwise movement of said lance tube, and brakes said second motor between the end of each counterclockwise movement and the beginning of each subsequent clockwise movement of said lance tube.

9. The sootblower as recited in claim 7, wherein said control circuit delays the rotation of said lance tube at the beginning of the extend stroke of the lance tube.

10. The sootblower as recited in claim 7, wherein said control circuit delays the rotation of said lance tube at the beginning of the retract stroke of the lance tube.

11. The sootblower as recited in claim 7, wherein said lance tube includes a nozzle near the distal end of the lance tube with respect to said carriage assembly, said nozzle emitting a jet of cleaning fluid during said extend and retract strokes.

12. The sootblower as recited in claim 7, further comprising a locator block and a sensor which determine whether or not the angular position of said lance tube is within a pre-determined range of angles at the end of the retract stroke.

13. The sootblower as recited in claim 12, further comprising a second control circuit that automatically compels said lance tube to rotate to a correct angular position within said pre-determined range of angles at the end of the retract stroke.

* * * * *